US007013824B2

(12) United States Patent
Otten et al.

(10) Patent No.: US 7,013,824 B2
(45) Date of Patent: Mar. 21, 2006

(54) KEEL JOINT CENTRALIZER

(75) Inventors: Jeffrey D. Otten, Cypress, TX (US); David Trent, Cypress, TX (US); Travis R. Jordan, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 10/645,112

(22) Filed: Aug. 21, 2003

(65) Prior Publication Data

US 2005/0039667 A1 Feb. 24, 2005

(51) Int. Cl.
*B63B 35/44* (2006.01)

(52) U.S. Cl. ..... 114/264; 441/3

(58) Field of Classification Search ..... 114/264; 441/3

See application file for complete search history.

(56) References Cited

U.S. PATENT DOCUMENTS 2,045,030 A * 6/1936 Thompson ..... 384/210
2,212,366 A * 8/1940 Donaldson ..... 384/268
5,873,677 A * 2/1999 Davies et al. ..... 405/195.1
5,950,737 A * 9/1999 Chou et al. ..... 175/5
6,283,205 B1 * 9/2001 Cannon ..... 166/241.1
6,422,791 B1 * 7/2002 Pallini et al. ..... 405/224.2
6,536,527 B1 * 3/2003 Munk et al. ..... 166/345
2001/0026845 A1 * 10/2001 Knight et al. ..... 427/446

* cited by examiner

*Primary Examiner*—Stephen Avila
(74) *Attorney, Agent, or Firm*—Nick A. Nichols, Jr.

(57) ABSTRACT

A riser centralizer for transferring lateral loads from the riser to a platform hull includes a keel centralizer mounted on a keel joint. The keel centralizer is received within a keel guide sleeve secured in a support mounted at the lower end of the platform hull. The keel centralizer includes a nonmetallic composite bearing ring having a radiused peripheral profile for minimizing contact stresses between the keel centralizer and the keel guide sleeve in extremes of riser and platform motion. The internal surface of the keel guide sleeve is clad with a corrosion resistant alloy and coated with a wear resistant ceramic rich coating.

6 Claims, 7 Drawing Sheets

KEEL JOINT CENTRALIZER

BACKGROUND OF THE DISCLOSURE

The present invention relates to keel joint centralizers for a tension leg platform (TLP) for testing and producing hydrocarbon formations in offshore waters.

Traditional TLPs having a four-column construction, include a four column semi-submersible floating substructure, multiple vertical tendons attached at each corner, tendon anchors to the seabed, and production risers. The TLP production deck is supported above the water surface by four columns that pierce the water plane. These types of TLPs typically bring a well(s) to the surface for completion and are meant to support from 20 to 60 wells at a single surface location. The production risers are restrained at the production deck and at the seabed. Restraint of the production risers in this manner allows environmental loading to move the risers considerable distances and requires large spacing between risers at the production deck to prevent riser interference.

Traditional solutions to guiding risers have utilized elastomeric joints, ball joints, and steel centralizers. These solutions have been used on Spars that are restrained to the seabed using mooring lines. TLPs, however, are connected to the ocean floor by rigid tendons, so the motions are smaller and a TLP hull is not typically as deep as a Spar hull. Spar hulls do not typically allow the use of external tieback connectors, which require an opening of at least 50 inches diameter. The present invention allows full passage of external tieback connectors, and is still compatible with internal tieback connectors having a smaller outside diameter.

In a mono-column TLP it is desirable to keep well bay spacing to a minimum, and to keep the hull diameter to a minimum. Therefore the production risers must be restrained at the lower end of the hull. Applying restraint to the production risers at the lower end of the hull produces an increase in bending stresses at the point of restraint. A common practice on subsea risers for controlling bending stresses has been the use of tapered riser keel joints to distribute the load over a sufficiently long section of the riser joint.

Some problems associated with previous keel joint riser centralizers include high cost and excessive friction forces applied to the TLP's hull. In addition, use of elastomeric concepts is very difficult to analyze and quantify their useful life. Previously used concepts on Spars have relied on a steel-to-steel interface, which is subject to corrosion, galling, high friction forces and requires a large size.

It is therefore an object of the present invention to provide a riser keel joint centralizer for transferring lateral loads from the riser to the TLP hull.

It is another object of the present invention to provide a riser keel joint centralizer having a radiused peripheral profile for preventing binding of the keel joint centralizer during riser and TLP motions.

It is yet another object of the present invention to provide a riser keel joint centralizer utilizing a non-metallic composite bearing material for minimizing contact stresses at the working surfaces of the keel centralizer.

It is still another object of the present invention to provide a riser keel joint centralizer including corrosion resistant properties.

It is still another object of the present invention to provide a riser keel joint centralizer for accommodating angular offset of a riser relative to a keel guide sleeve.

It is still another object of the present invention to provide a riser keel joint centralizer generating low friction without stick-slip characteristics at the riser to platform hull interface.

SUMMARY OF THE INVENTION

In accordance with the present invention, a riser centralizer for transferring lateral loads from the riser to a platform hull includes a keel centralizer mounted on a keel riser joint. The keel centralizer is received within a keel guide secured in a guide structure mounted at the lower end of the platform hull. A radiused peripheral profile enables the keel centralizer to avoid binding in extremes of riser and platform motions. The keel centralizer includes a non-metallic composite bearing ring having a modulus of elasticity sufficiently low to allow deflection of the bearing ring to spread environmental loads applied to the platform hull over a larger area thereby minimizing contact stresses between the keel centralizer and the keel guide. The keel guide is clad with a corrosion resistant material and coated with a wear resistant ceramic rich coating.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings. It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
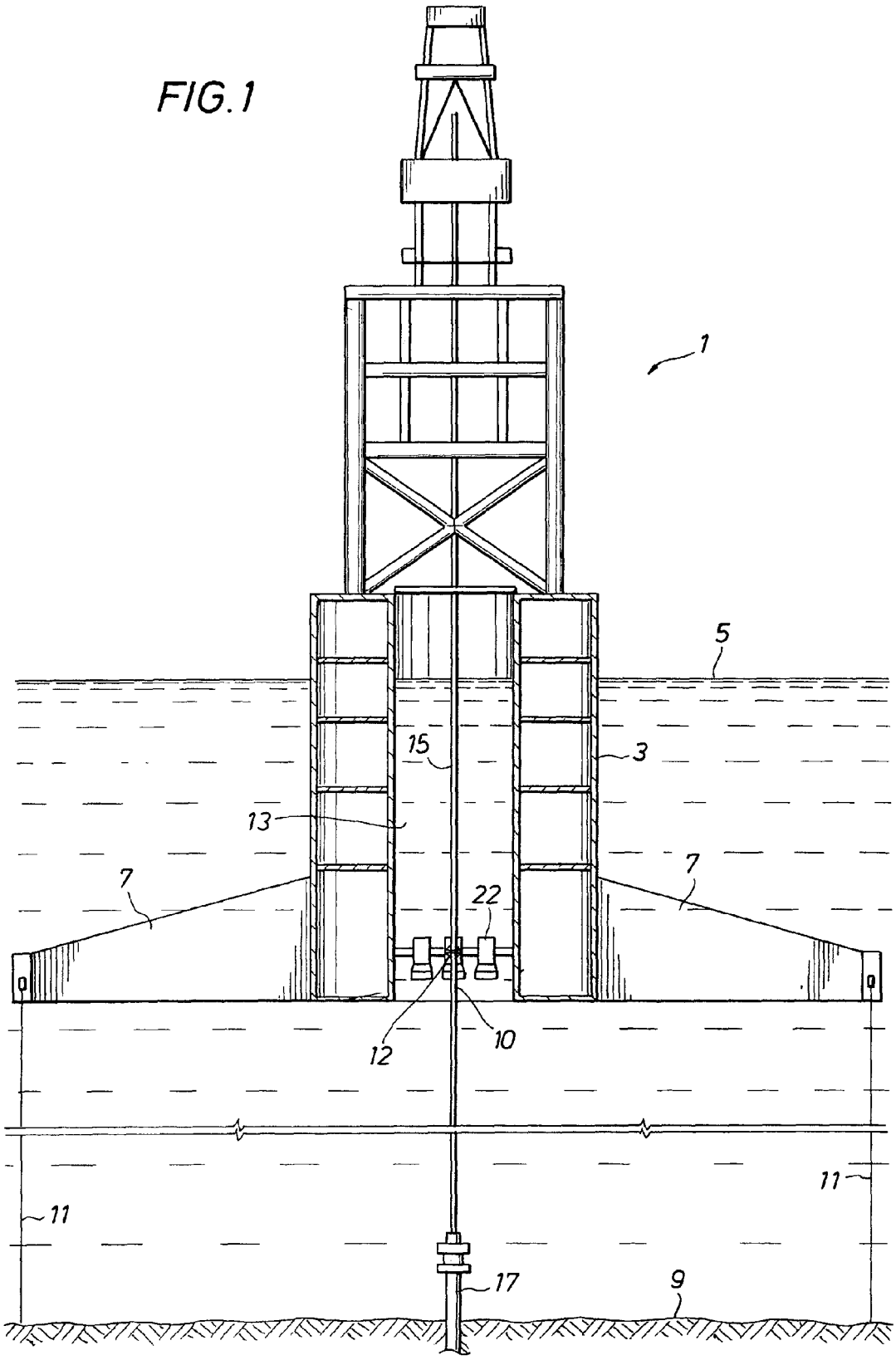
FIG. 1 is a partially broken away side view of a tension leg platform depicting the keel centralizer assembly of the present invention secured at the lower end of the platform hull.

Referring first to FIG. 1, a mono-column TLP platform, generally identified by the reference numeral 1, is shown.

The platform 1 includes a column or hull 3 projecting above the water surface 5 supporting one or more platform decks thereon. Pontoons 7 extend radially outward from the base of the hull 3. The floating platform 1 is anchored to the seabed 9 by tendons 11. The hull 3 includes an axial passage or central moonpool 13 extending therethrough, which moonpool 13 is open at the lower and upper ends thereof.

Production risers 15 extend from a wellhead 17 at the seabed 9 to the production deck of the platform 1. The production risers 15 are tubular members connected end to end providing a protective barrier for production and/or injection tubing extending therethrough. The production and injection tubing provide passageways for hydrocarbons, such as gas and oil, or injection fluids to flow between the wellhead 17 and the production deck of the platform 1, and then to storage facilities. The production risers 15 may be thousand of feet in length and are typically restrained at the production deck of the platform 1 and at the seabed 9. The production risers 15 are therefore affected by environmental loading, such as ocean currents, and may be moved considerable distances laterally. To prevent riser interference at the production deck of the platform 1, large spacing between risers 15 is typically required.

For mono-column TLP platforms, illustrated in FIG. 1, it is desirable to keep the well bay spacing and platform hull diameter to a minimum. Therefore, in a preferred embodiment of the present invention, the production risers 15 extend through the moonpool 13 in the platform hull 3. Only one production riser is shown in the drawings for purposes of illustration, however, it is understood that multiple production risers 15 may extend through the moonpool 13 of the platform hull 3. Lateral movement of the production risers 15 is restrained at the lower end of the platform hull 3 by the keel centralizer of the present invention. The upper ends of the production risers 15 are connected to hydraulic tensioners (not shown in the drawings) mounted on the production deck of the platform 1 for providing vertical tension to the production risers 15 in a known manner.

Figure 2:
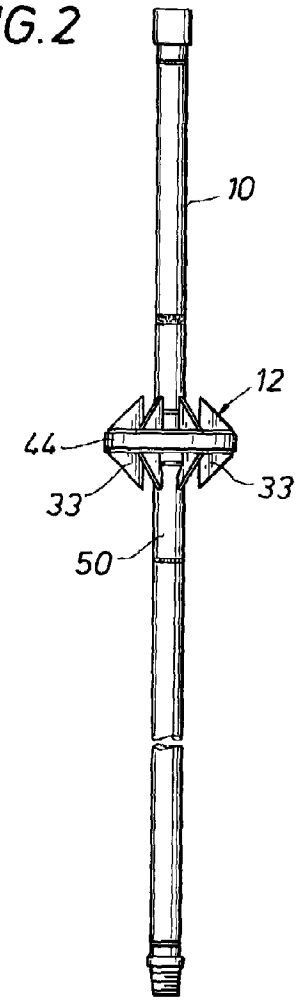
FIG. 2 is a side view of a riser keel joint and keel centralizer of the present invention.
Figure 9:
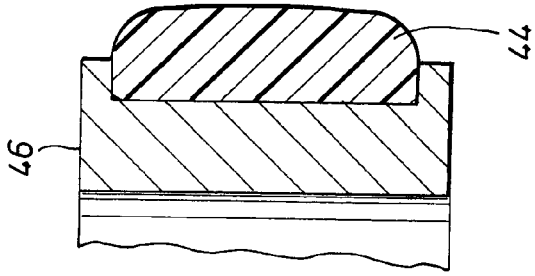
FIG. 9 is section view taken along line 9—9 in FIG. 3B.

Referring now to FIG. 2, a riser keel joint 10, in accordance with the present invention, is shown. A keel centralizer 12 is mounted on the riser keel joint 10. The riser keel joint 10 is one of the tubular members of the production risers 15. The riser keel joint 10 is located in the production risers 15 so that it is received in a guide sleeve of the keel centralizer assembly of the invention described in greater detail below.

Figure 4:
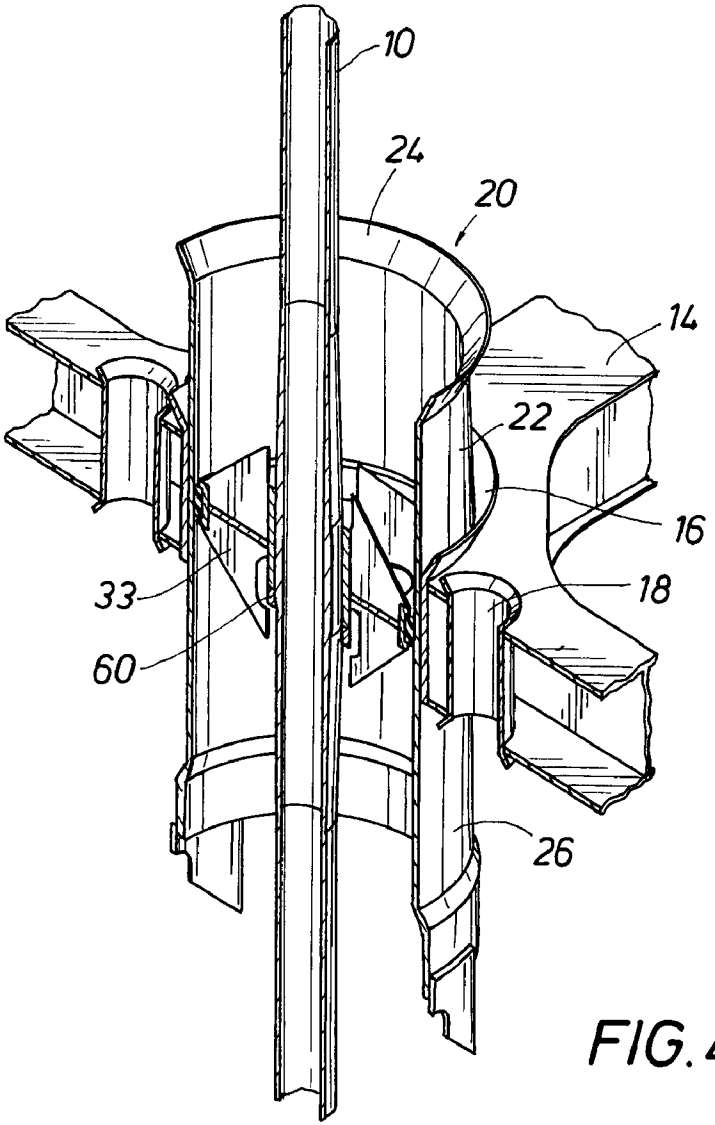
FIG. 4 is a perspective section view of a riser keel joint and the keel centralizer assembly of the present invention.
Figure 6B:
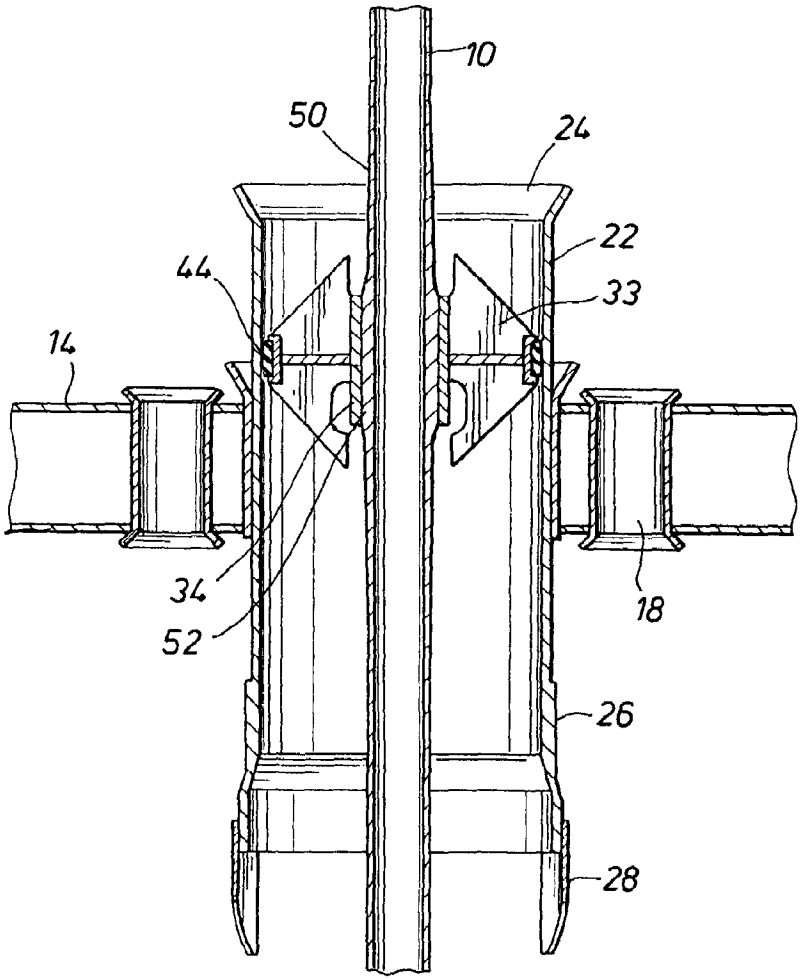
FIGS. 6A–6C are section views of a riser keel joint and the keel centralizer assembly of the present invention illustrating the position of the keel centralizer during an up/down stroke cycle.
Figure 6A:
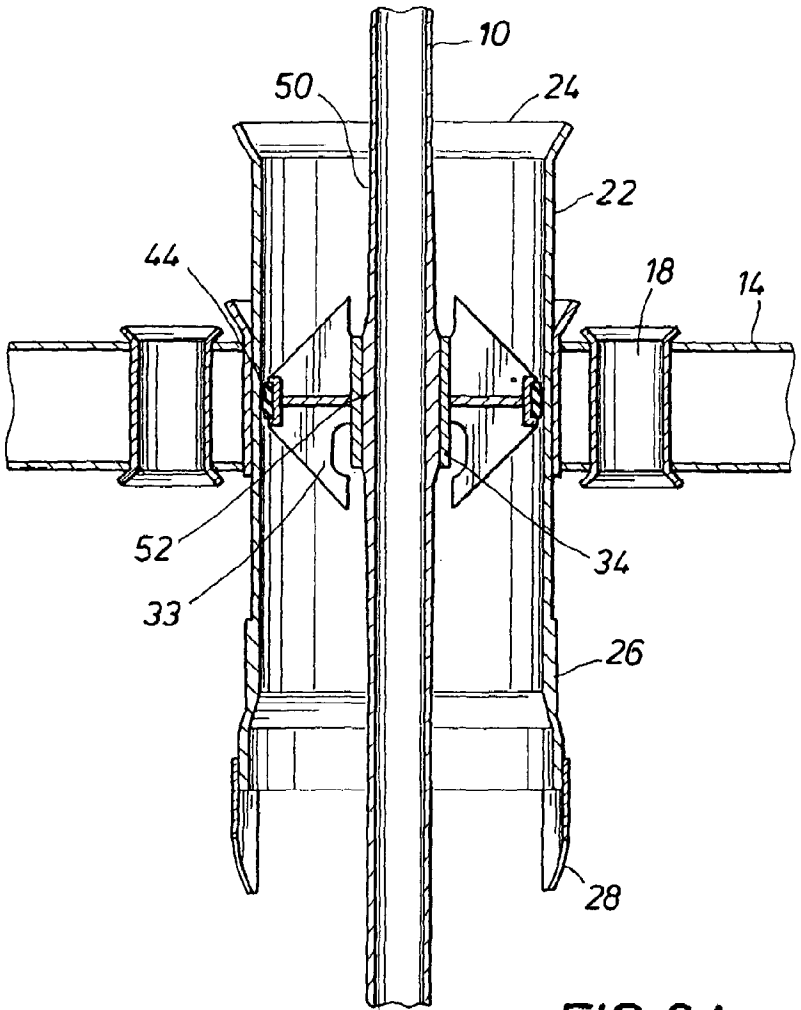
Figure 7:
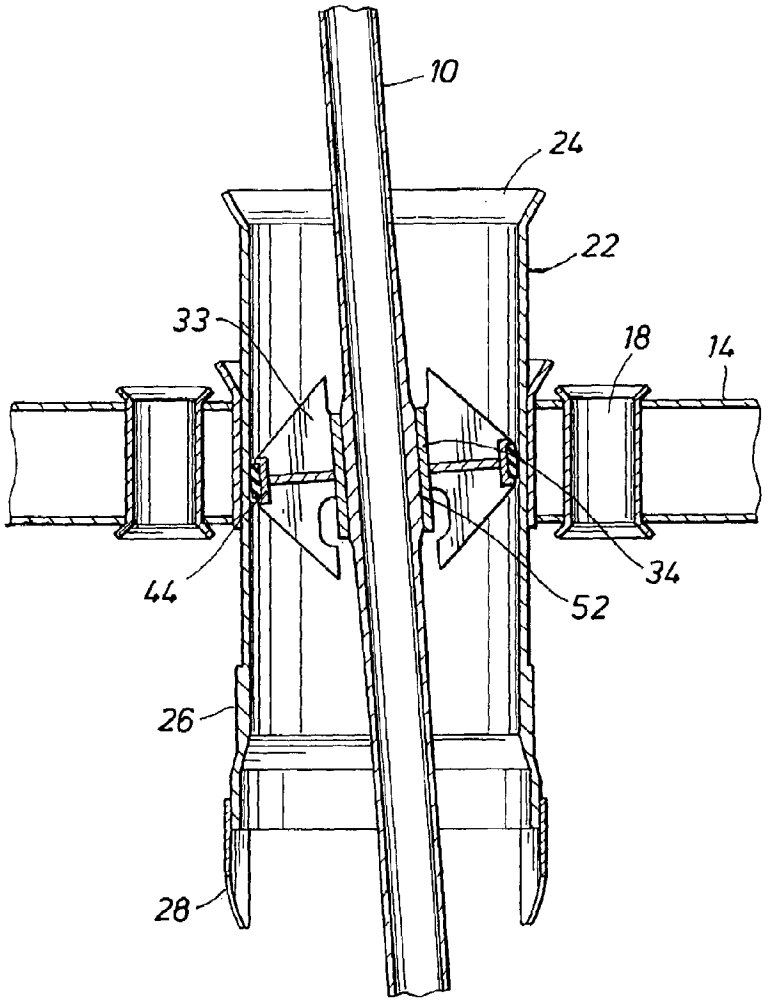
FIG. 7 is a section view of a riser keel joint and the keel centralizer assembly of the present invention illustrating angular offset of the keel centralizer relative to the keel guide sleeve.
Figure 6C:
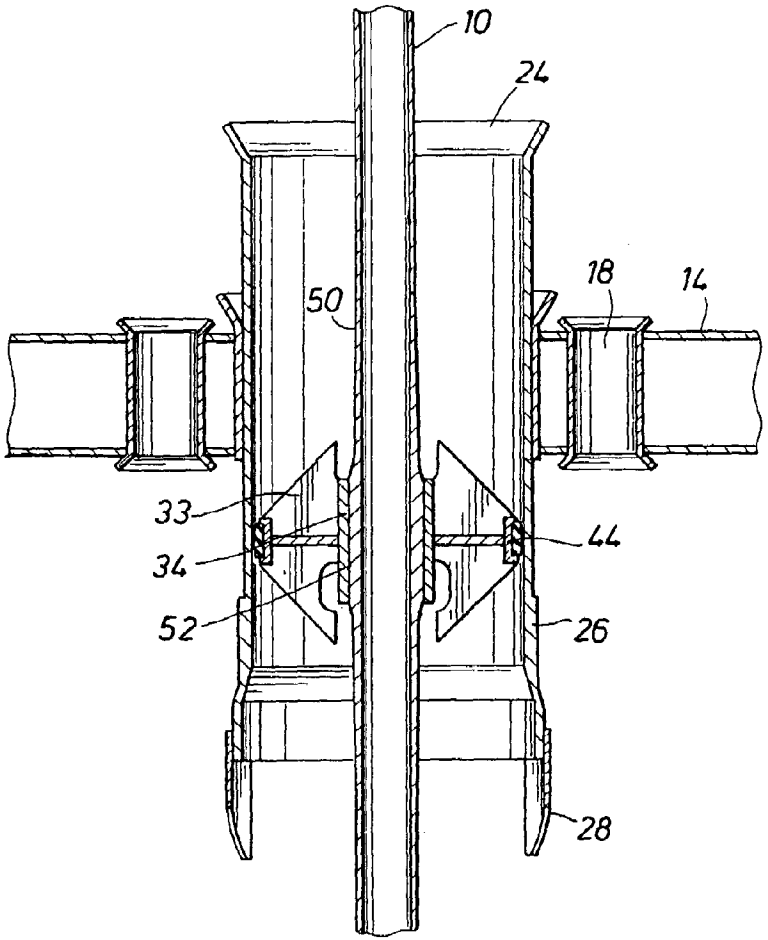

Referring now to FIG. 4, the keel centralizer 12 of the invention is received in a wear sleeve 20 mounted in a support frame 14. The wear sleeve 20 comprises a tubular body 22 that extends above and below the support frame 14. The wear sleeve body 22 is preferably fabricated of rolled steel plate. A guide flange 24 extending radially outward at about a 45° angle is welded to the upper end of the wear sleeve body 22. The guide flange forms a funnel-like entrance to the wear sleeve 20 and aids in guiding the keel centralizer 12 into the wear sleeve 20. A ring 26 is welded or otherwise secured to the lower end of the wear sleeve body 22. Downwardly opening lock brackets 28 are mounted to opposite sides of the ring 26 and are aligned for releasably receiving a riser guide (not shown in the drawings) for guiding the production risers 15 to the wellhead 17.

The internal surface of the sleeve body 22 is clad with a corrosion resistant alloy which is ground or machined to a final size to form a smooth bearing surface. Further enhancement of the wear and friction characteristics of the keel centralizer of the invention is obtained by applying a coating containing ceramic particles on the internal surface of the sleeve body 22. The coating may include marine fouling resistance to facilitate the removal of marine growth on the sleeve body 22.

In a preferred embodiment of the invention, properties of the coating applied to the body 22 of the wear sleeve 20 preferably include adhesion strength from 25.5 Mpa to 27.98 Mpa and a wear resistant average loss of 10 mg or less per 1000 cycles per ASTM D4060 Tabor abrasion using a load of 1000 g on CS 17 wheels. The wear resistant average loss of the coating would more preferably be 5 mg or less per 1000 cycles per ASTM D4060 Tabor abrasion using a load of 1000 g on CS 17 wheels. The flexibility percent elongation average of the coating is in the range of 10% to 20%. More preferably the flexibility percent elongation average of the coating is 15%. The low static friction value of the coating is preferably from 0.133 to 0.153 per ASTM D4518–90. The water permeability coefficient of the coating is preferably in a range from 0.0019 to 0.0021 (g/Pa*s*m) and the impact resistance range of the coating is preferably 89–91 inch-pounds per ASTM D2794 Intrusion Direct Impact. In addition, the ceramic rich coating applied to the sleeve 20 preferably exceeds 2000 hours of exposure to Salt Fog Test per ISO 7253, and more preferably exceeds 6000 hours.

Figure 8:
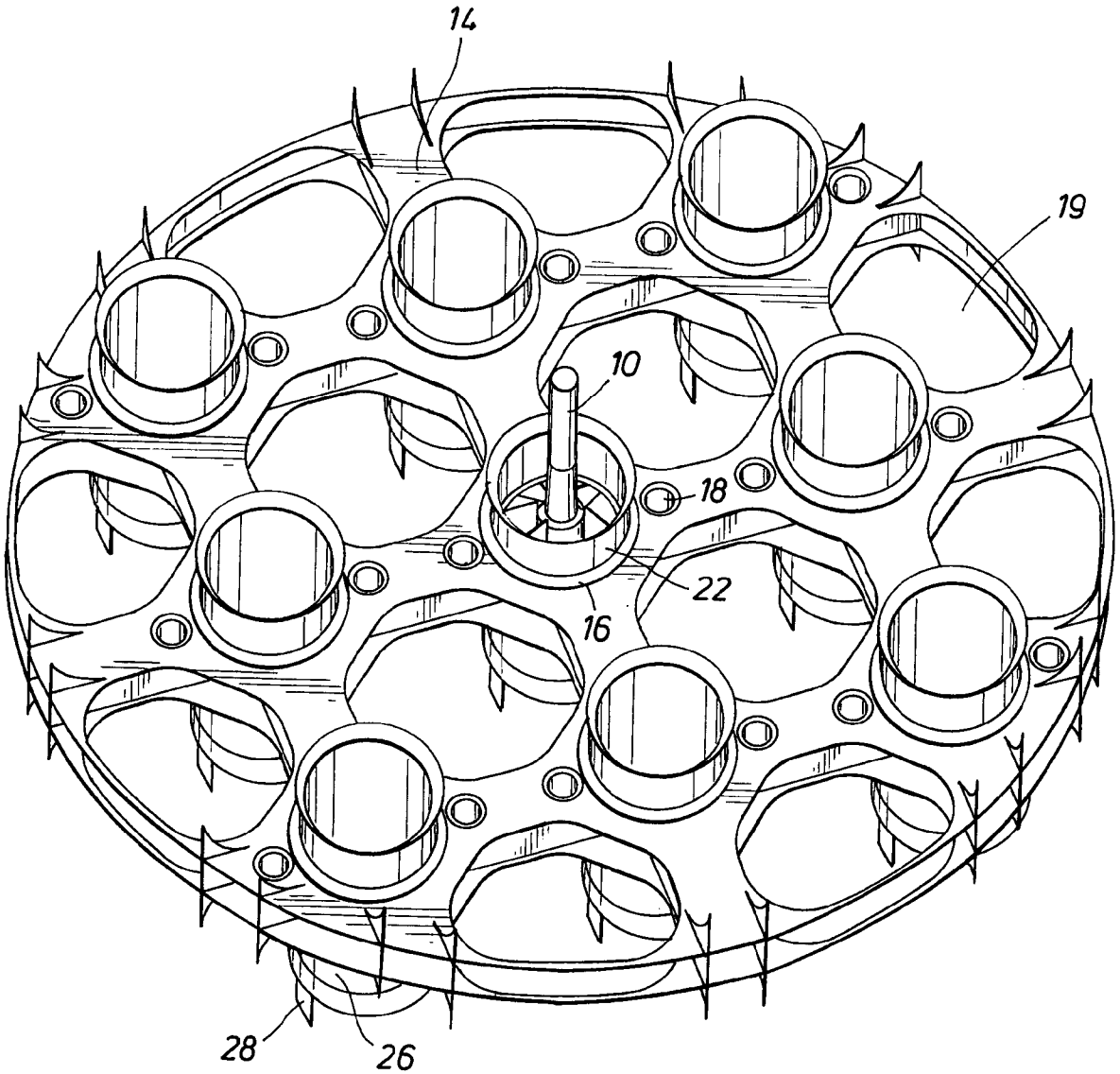
FIG. 8 is perspective view of the keel centralizer assembly of the present invention.

The wear sleeve 20 is mounted in a keel support frame 14 extending across the moonpool 13 of the platform hull 3. The support frame 14 is oriented substantially perpendicular to the axial axis of the hull 3. The frame 14, best shown in FIG. 8, supports one or more wear sleeves 20 spaced substantially equidistant from each other across the support frame 14. The support frame 14 is welded or otherwise secured at the lower end of the platform hull 3 in the moonpool 13, as shown in FIG. 1. The support frame 14 may include wear sleeve guides 16 mounted thereon for aiding in guiding the wear sleeve 20 onto the support frame 14, which wear sleeve 20 is affixed to the support frame 14 by welding or the like. Openings 18 formed in the frame 14 adjacent to the wear sleeve 20 provide passageways for guidelines or the like which may be required to guide the production risers 15 to the wellhead 17. Additional openings 19 formed in the frame 14 permit fluid, such as seawater, to pass through the frame 14.

Figure 3B:
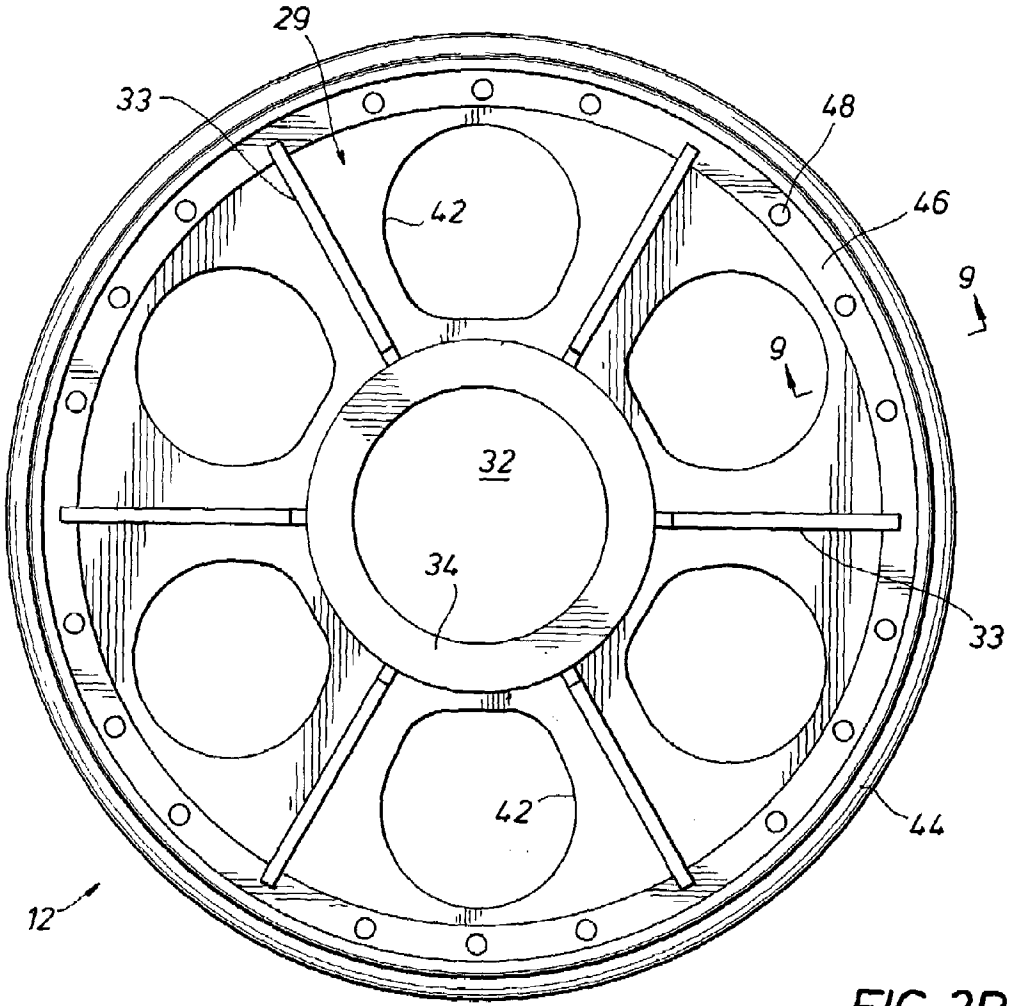
FIG. 3B is a top plan view of the keel centralizer of the present invention.
Figure 3A:
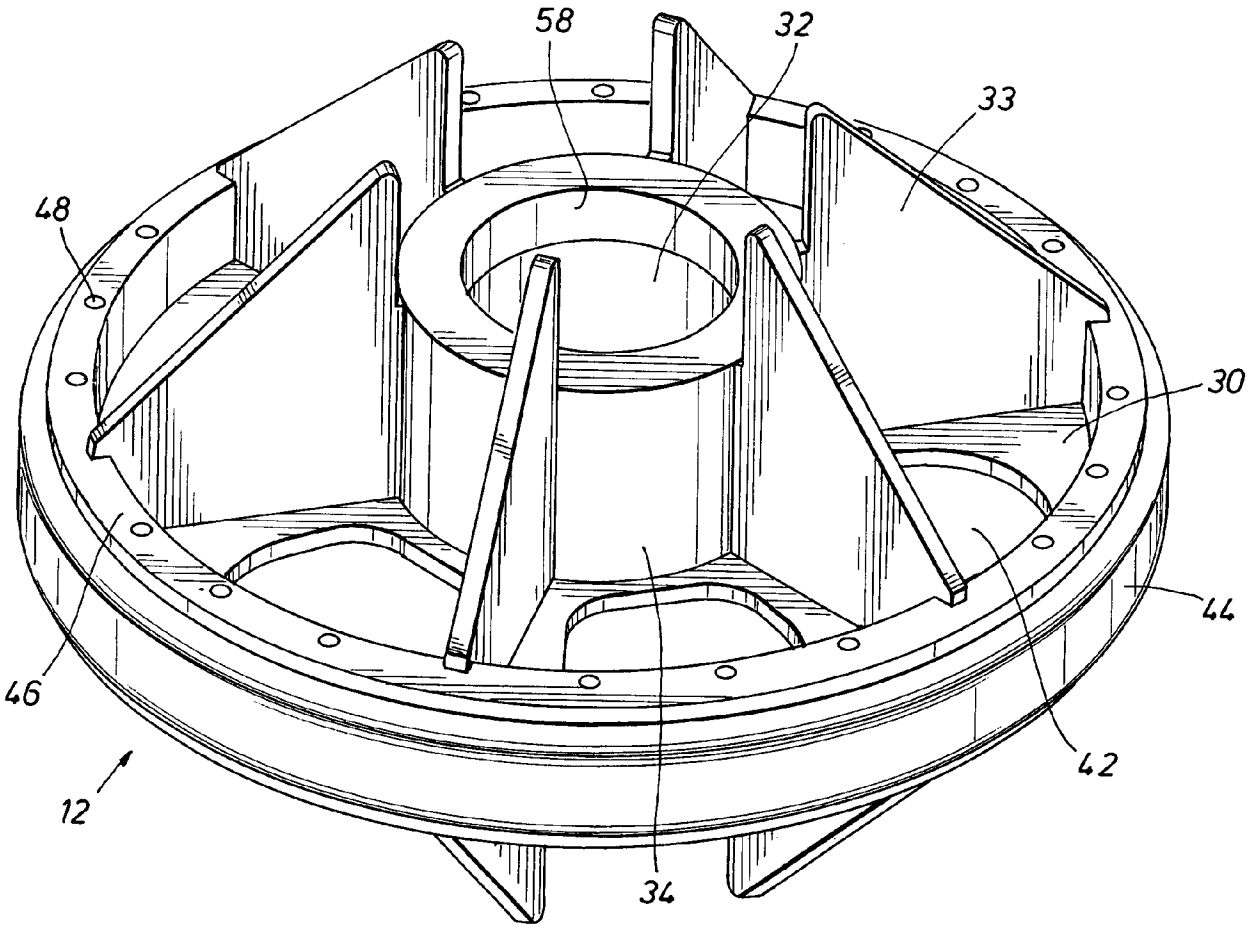
FIG. 3A is a perspective view of the keel centralizer of the present invention.

Referring now to FIGS. 3A and 3B, the keel centralizer 12 comprises a substantially flat body 29 defined by first and second planar surfaces 30. The planar surfaces 30 are generally opposed and define the thickness of the body 29 of the keel centralizer 12. A centrally located bore 32 defines the rotational axis of the keel centralizer 12 and is adapted to receive a mounting member, such as the keel joint 10. The bore 32 is further defined by integrally formed collars 34 that circumscribe the bore 32 and project outwardly from the surfaces 30 of the keel centralizer body 29. The collars 34 are oriented perpendicular to the flat body 29 of the keel centralizer 12 and provide axial length to the bore 32. It is understood that the diameter of the bore 32 may vary to accommodate the diameter of the keel joint 10 received through the bore 32. Angular brace members 33 welded between the planar surfaces 30 and the outer surface of the collars 34 provide additional structural strength to the keel centralizer 12.

Figure 5:
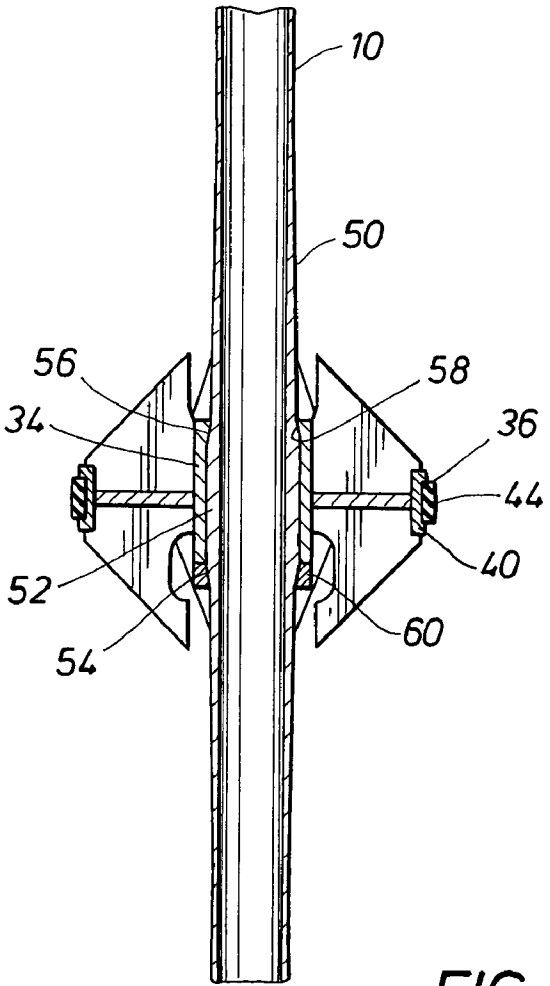
FIG. 5 is a section view of a riser keel joint and the keel centralizer of the present invention.

Referring still to FIGS. 3A and 3B, the opposed planar surfaces 30 of the keel centralizer 12 terminate at the outer periphery of the body 29 of the keel centralizer 12 which is defined by a continuous end surface that extends between the keel centralizer surfaces 30, thereby defining the thickness of the keel centralizer body 29. The keel centralizer 12 further includes a circumferential flange member 36, which may be welded on or integrally formed with the keel centralizer body 29, as best shown in FIG. 5. The flange member 36 includes an integrally formed radially outwardly projecting circumferential shoulder 40 forming the lower end thereof. One or more apertures 42 formed in the keel centralizer body 29 provide passageways for fluid to pass through the keel centrtalizer 12.

The keel centralizer 12 transfers loads from the production risers 15 to the platform hull 3. The keel centralizer 12 is received in the keel sleeve 22, as shown in FIG. 4, and is free to move with respect to the keel sleeve 22. Contact stresses that may damage the working surfaces of the keel centralizer 12 and the keel sleeve 22 are minimized by a nonmetallic bearing ring 44 secured on the flange member 36 about the outer periphery of the keel centralizer body 29. The bearing ring 44 is fabricated of composite material having a modulus of elasticity that is lower than that of steel. The modulus of elasticity of the bearing ring 44 is in the range of 0.3×10^6 to 3.0×10^6, and more preferably is 0.5×10^6, compared to 30×10^6 for steel. The lower modulus of elasticity allows sufficient deflection of the bearing ring 44 to spread the load of the production risers 15 over a larger area. The bearing ring 44 characteristics further include dimensional stability in water of 0 to 0.5% and impact resistance of 5 to 20 ft-lb/in. More preferably, the bearing ring 44 dimensional stability in water is <0.1% and its impact resistance is >10 ft-lb/in IZOD. The compressive strength normal to laminate of the bearing ring 44 is in the range of 20,000 psi to 50,000 psi and its coefficient of friction is in the range of 0.01 to 0.15 in water and 0.1 to 0.2 dry. It is preferred that the bearing ring 44 have compressive strength normal to laminate >40,0000 psi and a coefficient of friction as low as 0.01 in water and 0.13 to 0.2 dry. The static coefficient of friction of the bearing ring 44 is preferably in the range of 0.13 to 0.15. The bearing ring 44 additionally includes a radiused profile for minimizing binding of the keel centralizer 12 within the keel sleeve 22 in all extremes of production riser and platform motions. Preferably the profile of the bearing ring 44 defines a spherical profile formed by radiused surfaces 45 and 47 on the bearing ring 44. The contact stresses of the keel centralizer 12 are sufficiently minimized by the bearing ring 44 to avoid galling of the keel sleeve 22 and enable the over all profile of the keel centralizer 12 to be maintained at a small compact size.

The bearing ring 44 is secured about the keel centralizer body 29 by expanding it sufficiently with heat to slide over the flange member 36 so that the lower edge of the bearing ring 44 abuts against the retaining shoulder 40 on the flange member 36. A capture ring 46, which may comprise a single ring or multiple ring segments, is secured to the top of the flange member 36 by bolts 48. The bearing ring 44 is thereby securely retained on the keel centralizer 12 between the capture ring 46 and the shoulder 40 of the flange member 36.

Referring now to FIG. 5, the keel centralizer 12 of the invention is mounted about a tapered portion 50 of the keel joint 10. The tapered portion 50 is a back to back tapered section formed on the keel joint 10 for controlling the bending stresses of the keel joint 10. The tapered portion 50 of the keel joint 10 includes an enlarged portion 52 defined between spaced and opposed transition shoulders 54 and 56 and machined to match the internal dimensions of the bore 32 extending through the keel centralizer body 29. The external diameter of the enlarged portion 52 is slightly larger than the internal diameter of the bore 32 of the keel centralizer 12. An interference fit is established by heating the keel centralizer 12 to expand the bore 32 so that it will slide over the enlarged portion 52 of the keel joint 10. An internal circumferential shoulder 58 formed adjacent the upper end of the collar 34 is machined to match the profile of the transition shoulder 56 of the enlarged portion 52 of the keel joint 10. The keel centralizer 12 is slid over the enlarged portion 52 until the shoulder 58 on the collar 34 engages the transition shoulder 56. A capture ring 60 machined to match the profile of the lower transition shoulder 54 of the keel joint 10 is positioned in facing contact therewith and welded to the lower end of the collar 34. As the heated keel centralizer 12 cools, an interference fit is formed about the enlarged portion 52 on the keel joint 10 securely locking it thereon.

In a preferred configuration of the present invention, a nonmetallic bearing ring 44 having a radiused peripheral profile mounted on the keel centralizer 12 and a corrosion resistant clad keel guide sleeve 22 painted with a wear resistant ceramic rich coating cooperate to minimize corrosion, galling and friction forces between the keel centralizer 12 and the keel guide sleeve 22. The radiused profile of the composite bearing ring 44 minimizes binding of the keel centralizer 12 as it slides freely within the keel guide sleeve 22 in response to the motions of production risers 15 and the platform 1. The dimensions of the keel guide sleeve 22 are designed to accommodate the extremes in environmental conditions for the offshore location of the offshore platform 1 and production risers 15 so that the keel centralizer 12 is not in danger of sliding out of the keel guide sleeve 22 in extreme environmental conditions. In FIGS. 6A–6C and FIG. 7, movement of the keel centralizer 12 within the keel guide sleeve 22 is depicted. During any up/down stroke, the keel centralizer 12 is free to move vertically and angularly without binding within the keel guide sleeve 22.

While a preferred embodiment of the invention has been shown and described, other and further embodiments of the invention may be devised without departing from the basic scope thereof, and the scope thereof is determined by the claims which follow.

What is claimed is:

1. A keel centralizer, comprising:

a) a flat keel centralizer body having a central bore extending through said body;

b) said keel centralizer body including a circumferential flange member defining the perimeter thereof;

c) at least one opening extending through said keel centralizer body;

d) a bearing ring mounted on said flange member; and e) a keel sleeve mounted in a keel support frame, said keel sleeve being adapted for slidably receiving said keel centralizer body, and wherein said keel sleeve is clad with a corrosion resistant material.

2. The keel centralizer of claim 1 wherein said bearing ring includes a radiused profile defining a peripheral contact surface of said keel centralizer.

3. The keel centralizer of claim 2 wherein said bearing ring is fabricated of a non-metallic composite material having a modulus of elasticity less than 30×10^6.

4. The keel centralizer of claim 3 wherein the modulus of elasticity of said composite material is 0.5×10^6.

5. The keel centralizer of claim 2 including a keel sleeve mounted in a keel support frame, said keel sleeve being adapted for slidably receiving said keel centralizer body, said keel sleeve further including a wear resistant coating applied on an internal surface thereof.

6. The keel centralizer of claim 5 wherein said wear resistant coating contains ceramic particles.

* * * * *